US008893732B2

(12) United States Patent
Kim

(10) Patent No.: US 8,893,732 B2
(45) Date of Patent: Nov. 25, 2014

(54) MAKEUP PUFF APPARATUS

(71) Applicant: Min Seok Kim, Ansan-si (KR)

(72) Inventor: Min Seok Kim, Ansan-si (KR)

(73) Assignees: Hichen Co., Ltd., Hwaseong-si, Gyeonggi-do (KR); Corea Puff Manufacturing Co., Ltd., Paju-si, Gyeonggi-do (KR)

( * ) Notice: Subject to any disclaimer, the term of this patent is extended or adjusted under 35 U.S.C. 154(b) by 0 days.

(21) Appl. No.: 13/808,980

(22) PCT Filed: Oct. 10, 2012

(86) PCT No.: PCT/KR2012/008195

§ 371 (c)(1),
(2), (4) Date: Jan. 8, 2013

(87) PCT Pub. No.: WO2013/065959

PCT Pub. Date: May 10, 2013

(65) Prior Publication Data

US 2013/0333718 A1 Dec. 19, 2013

(30) Foreign Application Priority Data

Oct. 31, 2011 (KR) ..... 10-2011-0111882
Feb. 10, 2012 (KR) ..... 10-2012-0013722

(51) Int. Cl.
*A45D 33/34* (2006.01)
*A45D 33/36* (2006.01)
*A45D 40/10* (2006.01)

(52) U.S. Cl.
CPC ..... *A45D 33/34* (2013.01); *A45D 33/36* (2013.01); *A45D 2200/207* (2013.01); *A45D 40/10* (2013.01)
USPC ..... 132/317; 132/320; 601/97; 601/84

(58) Field of Classification Search
CPC . A45D 33/34; A45D 33/36; A45D 2200/207; A45D 2200/1018; A45D 2200/1009; A45D 2040/00; A45D 2040/0006
USPC ..... 132/317, 293, 294, 320, 73.6, 75.8; 15/22.1, 22.2, 28; 601/46, 84, 97, 101, 601/103, 104, 20
See application file for complete search history.

(56) References Cited

U.S. PATENT DOCUMENTS 4,027,348 A * 6/1977 Flowers et al. ..... 15/22.1
5,471,695 A * 12/1995 Aiyar ..... 15/22.1
6,319,211 B1 * 11/2001 Ito et al. ..... 601/7
6,449,792 B1 * 9/2002 Myers ..... 15/28
7,282,036 B2 * 10/2007 Masuda ..... 601/72
8,469,041 B2 * 6/2013 Pires et al. ..... 132/218
8,505,556 B2 * 8/2013 Park et al. ..... 132/320
8,561,241 B2 * 10/2013 Lim et al. ..... 15/22.2

(Continued)

*Primary Examiner* — Robyn Doan
*Assistant Examiner* — Tatiana Nobrega
(74) *Attorney, Agent, or Firm* — Novick, Kim & Lee, PLLC; Jae Youn Kim

(57) ABSTRACT

Disclosed herein is a makeup puff apparatus. A puff is coupled in such a way so as to be freely movable, and is very efficiently designed to have functionality including flexibility, elasticity and a restoring force, thus ensuring durability resulting from firm coupling and enabling reliable operation, and thereby considerably increasing the ease and convenience of use. Particularly, the apparatus enables flexible motion and adjustment of the puff in conformity with a variation in angle on a touch portion when the apparatus is in use, thus continuously maintaining a soft touch sensation of the puff, and allows the apparatus to be immediately restored to its original state, thus preventing the angle of the puff from deviating from a predetermined angle.

8 Claims, 7 Drawing Sheets

(56) References Cited

U.S. PATENT DOCUMENTS

2002/0156402 A1* 10/2002 Woog et al. ..... 601/46
2007/0000566 A1* 1/2007 Gueret ..... 141/98
2008/0087296 A1* 4/2008 Gueret ..... 132/317
2011/0084097 A1* 4/2011 Gueret ..... 222/196
2011/0106067 A1* 5/2011 Geva et al. ..... 606/9
2013/0156487 A1* 6/2013 Haan ..... 401/143

* cited by examiner

MAKEUP PUFF APPARATUS

TECHNICAL FIELD

The present invention relates to a makeup puff apparatus, and more particularly, to a makeup puff apparatus, which enables flexible motion and adjustment in conformity with a variation in angle on a touch portion, thus allowing the puff apparatus to softly touch a face, and which has a restoring force, thus preventing an angle of a puff from deviating from a predetermined angle, in addition to affording convenient use.

BACKGROUND ART

Generally, in order to naturally cover blemishes and freckles of the skin exposed to the outside, such as the face, or to create clean and brilliant skin or clear and smooth skin, cosmetics such as foundation, concealer, twin cake and cosmetic powder are widely used.

The cosmetic powder should be evenly spread and perfectly applied to a desired portion without turning cakey. To this end, a makeup tool is used, which is referred to as a "puff".

Such a makeup puff may be used to apply cake-phased cosmetics, paste or liquid foundation as well as the powder-phased cosmetics. The makeup puff is classified into a manual puff and an electric puff. The manual puff has a finger insert band on a surface thereof, so that a user may spread and apply cosmetics to a desired portion by dabbing this portion with the puff covered with the cosmetics after inserting the user's finger into the finger insert band. The electric puff is automatically operated to put on makeup.

The electric puff is provided with an electric motor, and is moved forwards and backwards by driving the electric motor, thus automatically dabbing a portion that is to be cosmetized.

However, the above-mentioned conventional electric puff is problematic in that a different electric power may be transmitted depending on the movement of the puff and a variation in angle on a touch portion, and an angle of the puff may deviate from a predetermined angle, and it is difficult to be immediately restored to its original state.

Thereby, the conventional electric puff is problematic in that it is inconvenient to use.

DISCLOSURE

Technical Problem

Accordingly, the present invention has been made keeping in mind the above problems occurring in the related art, and an object of the present invention is to provide a makeup puff apparatus, which utilizes flexibility and elasticity and is efficiently designed therefor, thus enabling flexible motion and adjustment in conformity with a variation in angle on a touch portion, and continuously maintaining a soft touch sensation, and which has a restoring force, thus preventing an angle of a puff from deviating from a predetermined angle.

Another object of the present invention is to provide a makeup puff apparatus, which affords firm coupling and besides increases durability and ensures reliable operation, thus contributing to the easy and convenient use of the puff apparatus.

Technical Solution

In an aspect, the present invention provides a makeup puff apparatus, including a body including a partition plate with a hole, thus defining open spaces, respectively, on a front portion and a rear portion of the body by the partition plate; a body cover disposed on the rear open space of the body to be fastened thereto, supporting a back of a puff connector inserted into the body, and including a battery terminal portion for mounting a battery on a rear surface of the body cover, and a push switch portion; the puff connector fitted into and located in the front open space of the body, and configured so that a tubular rear portion having an inner hollow portion to provide flexibility and elasticity is integrated with a block-shaped front portion having a vibration-motor mounting hole to communicate with the inner hollow portion; a vibration motor inserted and mounted into the vibration-motor mounting hole of the puff connector; a puff holder for firmly coupling or simply detaching a puff to or from the puff connector; the puff attached to a front face of the puff holder via a double-sided tape or an adhesive, and fitted over a front end of the puff connector together with the puff holder; and a switching cover rotatably coupled to the rear portion of the body, with a pressing portion provided in the switching cover to have a step between left and right sides, thus switching the push switch portion on or off by a rotating operation.

Advantageous Effects

According to the present invention, a puff is coupled in such a way so as to be freely movable, and is very efficiently designed to have functionality including flexibility, elasticity and a restoring force, thus ensuring durability resulting from firm coupling and enabling reliable operation, and thereby considerably increasing the ease and convenience of use.

Particularly, the present invention enables flexible motion and adjustment of a puff in conformity with a variation in angle on a touch portion when a puff apparatus is in use, thus continuously maintaining a soft touch sensation of the puff, and allows the puff apparatus to be immediately restored to its original state, thus preventing an angle of the puff from deviating from a predetermined angle.

BEST MODE

The preferred embodiments of the present invention will be described below, and thus the objects, configuration, and features of the present invention will be more clearly understood by way of the description.

Figure 1:
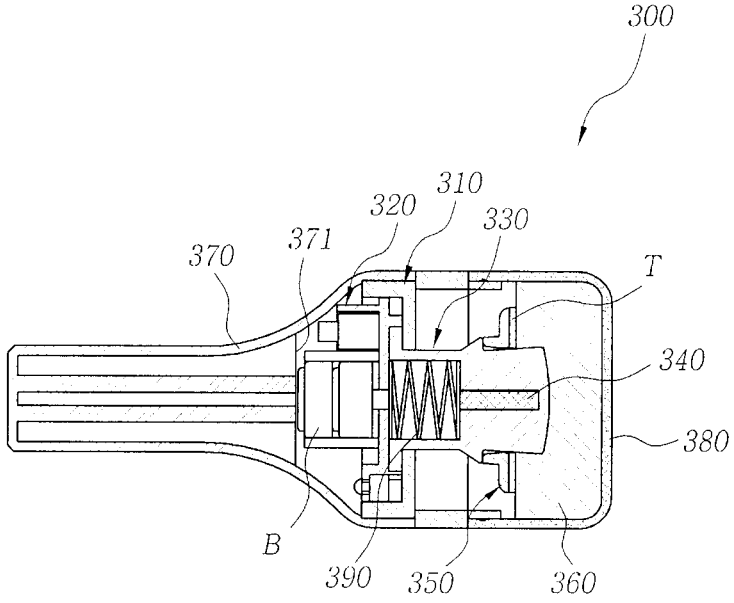
FIG. 1 is a sectional view showing a makeup puff apparatus according to an embodiment of the present invention in an assembled state thereof.
Figure 2:
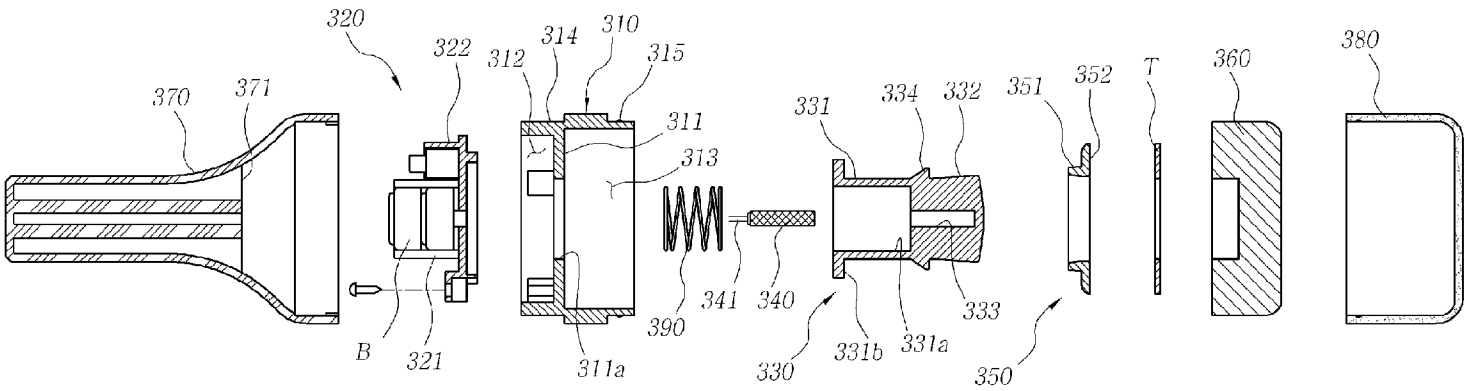
FIG. 2 is an exploded sectional view showing a configuration of FIG. 1 according to the present invention.

As shown in FIGS. 1 and 2, a makeup puff apparatus 300 according to an embodiment of the present invention includes a body 310, a body cover 320, a puff connector 330, a vibration motor 340, a puff holder 350, a puff 360, a switching cover 370, and a puff cover 380.

Open spaces 312 and 313 are defined in the body 310 in such a way so as to be located on front and rear portions of the body with respect to a partition plate 311 having a hole 311*a*, and coupling grooves 314 and 315 are formed on an outer surface of the body to be coupled to the switching cover 370 and the puff cover 380, respectively.

The body cover 320 serves as both a fastening member that is disposed on the rear open space 312 of the body 310 to be fastened thereto, and as a support member that supports a back of the puff connector 330 inserted into the body 310.

The body cover 320 includes a battery terminal portion 321 that is adapted to mount a battery B on a rear surface thereof, and a push switch portion 322. Wiring is performed to make electrical connection between the battery terminal portion 321 and the switch portion 322.

The puff connector 330 is made of a rubber or silicone material to have flexibility and elasticity. It is preferably configured to have useful characteristics, such as flexibility and elasticity, to usefully function as a connector for securing the puff 360 to a front end of the body 310, and to maintain firm coupling with the puff 360.

In other words, in order to meet the above requirements, according to the present invention, the puff connector 330 is configured so that a rear portion 331 has a tubular structure with an inner hollow portion 331*a*, while a front portion 332 has a block structure that is solid therein.

Further, a vibration-motor mounting hole 333 is formed in the block-shaped front portion 332 of the puff connector 330 so that the vibration motor 340 is inserted and mounted to the vibration-motor mounting hole. This vibration-motor mounting hole is formed to communicate with the inner hollow portion 331*a* of the rear portion, thus enabling the vibration motor 340 to be easily inserted and mounted to the puff connector 330 from a rear position.

Moreover, a locking protrusion 331*b* is provided on a rear end of the rear portion 331 on the puff connector 330 in such a way so as to protrude outwards, with a locking step 334 protruding from an outer surface of the puff connector.

Here, the locking protrusion 331*b* of the puff connector 330 is located behind the partition plate 311 to be locked thereto when the puff connector 330 is inserted into the body 310, and is firmly supported by the body cover 320 when the body cover 320 is fastened to the body 310 at a rear position thereof. Thus, the locking protrusion is a component that allows the puff connector 330 to be reliably coupled to the body 310.

Further, the locking step 334 of the puff connector 330 restricts the movement of the puff holder 350 towards the puff connector 330, with the puff holder functioning to firmly hold the puff 360. The locking step is a component that prevents the puff 360 and the body 310 from coming into contact with each other, thus enabling the puff 360 to naturally and flexibly move even when the body vibrates and shakes.

Here, the puff connector 330 may be formed to have a circular or polygonal cross-section.

The vibration motor 340 provides the shake resulting from the vibration to the puff 360, and is fixedly inserted into the vibration-motor mounting hole 333 of the puff connector 330.

The vibration motor 340 has a wire 341 to be supplied with operating power, and is connected to the battery terminal portion 321 and the push switch portion 322 of the body cover to be supplied with power and receive an operating signal.

The puff holder 350 functions to firmly couple the puff 360 to the puff connector 330 while allowing for the simple detachable coupling of the puff 360. The puff holder has a through hole so that the puff connector 330 is inserted therein, with a rear protruding portion 351 being formed on the puff holder to face the locking step 334 of the puff connector 330.

The puff 360 is made of a latex or sponge (MBR foam, etc.) material, and is attached to a front face 352 of the puff holder 350 via a double-sided tape or an adhesive T. The puff is integrally coupled to the puff holder 350 to be more simply detachably coupled to the puff connector 330.

Here, the puff 360 is located at a front end of the puff connector 330 to be fixedly coupled thereto, and is positioned in front of the body 310 in such a way that it is not in contact with the body 310, as a result of which it is possible to mount the puff to be freely movable.

The switching cover 370 is rotatably coupled to the body 310 from a rear position of the body 310 in a fitting manner. The switching cover serves as an ON/OFF switching means that pushes the push switch portion 322 by the rotation of the switching cover to provide vibration to the puff 360. Additionally, the switching cover serves as a handle means for gripping the puff apparatus 300 and a cover means for covering the body cover 320.

A pressing portion 371 is provided in the switching cover 370 to have a step between left and right sides. The pressing portion 371 is configured to perform an ON/OFF switching function for the push switch portion 322 depending on a rotating position of the switching cover 370.

The puff cover 380 is a cover means for protecting the puff 360.

In addition, according to the present invention, an elastic member 390 such as a spring may be further provided to maintain flexibility and elasticity for the puff connector 330, further increase a restoring force, and besides serve as a support structure for the puff connector 330. The elastic member is preferably inserted into the inner hollow portion 331*a* of the rear portion 331 of the puff connector 330.

Preferably, the elastic member 390 has a size corresponding to that of the inner hollow portion 331*a* of the puff connector 330. This allows the elastic member to be inserted into the inner hollow portion 331*a* in such a way so as to be in close contact therewith, thus making it possible to more efficiently perform the function of the support structure.

In the makeup puff apparatus 300 according to the present invention constructed as described above, while the vibration motor 340 is inserted into the vibration-motor mounting hole 333 of the puff connector 330, the rear end of the puff connector 330 is inserted into the body 310.

Here, if the elastic member 390 is included, it is inserted into the inner hollow portion 331*a* of the rear portion of the puff connector 330.

Subsequently, the body cover 320 equipped with the battery B is fastened to the rear portion of the body 310 to be secured thereto.

Here, the body cover 320 fastened to the body 310 makes the locking protrusion 331*b* of the puff connector 330 come into close contact with the partition plate 311 to be supported thereto, thus serving as a coupling promoting member that more firmly couples the puff connector 330 to the body 310.

Thereafter, the puff 360 is reliably secured to the puff connector 330 in the coupling state realized by fitting the puff holder 350 over the front end of the puff connector 330. Further, the switching cover 370 is fitted over the rear portion of the body 310, while the puff cover 380 is fitted over the front portion of the body.

Figure 3:
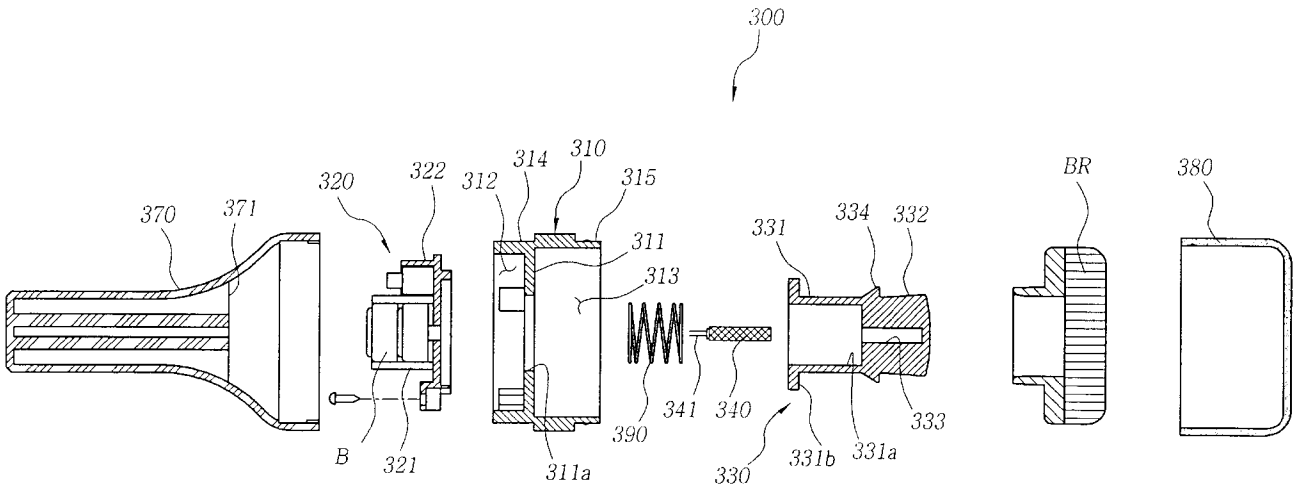
FIG. 3 is a view illustrating a configuration including a facial washing brush that substitutes for a puff, in the present invention.

In addition, as shown in FIG. 3, the makeup puff apparatus 300 according to the present invention may substitute a facial washing brush BR for the puff 360. This enables a user to more cleanly wash his or her face so as to put on or remove makeup.

Preferably, as shown in FIG. 3, a body of the facial washing brush BR is directly fitted over the puff connector 330.

Figure 4:
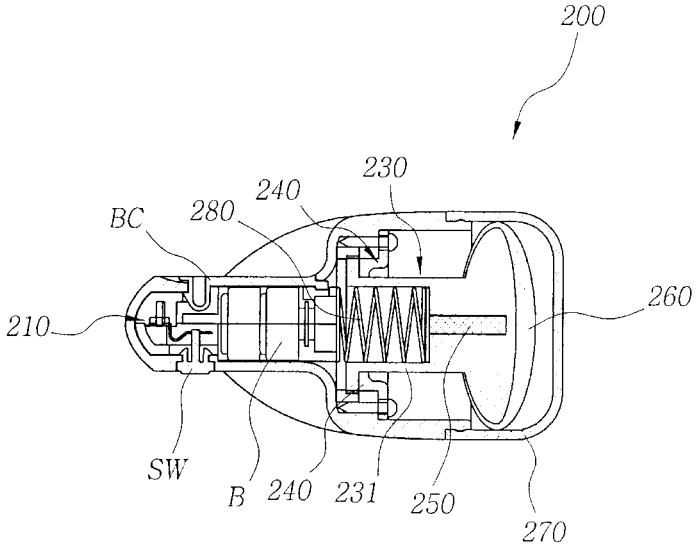
FIG. 4 is a sectional view showing a makeup puff apparatus according to another embodiment of the present invention in an assembled state thereof.
Figure 5:
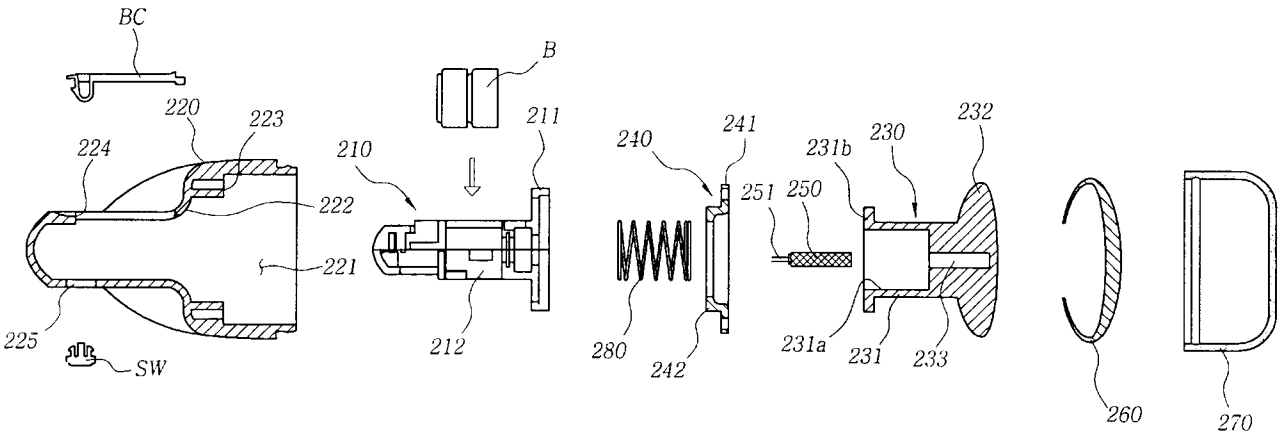
FIG. 5 is an exploded sectional view showing a configuration of FIG. 4 according to the present invention.

Meanwhile, FIGS. 4 and 5 illustrate a makeup puff apparatus 200 according to another embodiment of the present invention, the makeup puff apparatus including a body 210, a body coupler 220, a puff connector 230, a fastening/supporting member 240, a vibration motor 250, a puff 260, and a puff cover 270.

A support plate 211 is provided on a front end of the body 210 in such a way so as to be in contact with a rear end of the puff connector 230, and a battery terminal portion 212 is integrally formed on a back of the support plate 211 to allow for the side mounting of a battery B.

The body coupler 220 has a corresponding structure that allows the body 210 to be inserted and protected, and may also serve as a handle means for gripping the puff apparatus 200. A first step portion 222 and a second step portion 223 are sequentially formed in a front portion of an inner space 221 that is open towards a front, so as to sequentially insert the body 210 and the fastening/supporting member 230 of the body coupler.

Here, an opening 224 is formed in an outer surface of the body coupler 220 to make the battery terminal portion 212 be opened when the body 210 is inserted, and a switch coupling hole 225 is formed in the outer surface of the body coupler to make an operating switch SW be coupled thereto.

The puff connector 230 is made of a rubber or silicone material to have flexibility and elasticity. It is preferably configured to have useful characteristics, such as flexibility and elasticity, to usefully function as a connector for securing the puff 260 to a front portion of the body 210, and to maintain firm coupling with the puff 260.

In other words, in order to meet the above requirements, according to the present invention, the puff connector 230 is configured so that a rear portion 231 has a tubular structure with an inner hollow portion 231*a*, while a front portion 232 has a block structure that is solid therein. A front end, i.e., head, of the puff connector is preferably structured in a convexly curved shape such that the apex protrudes outwardly toward the puff so as to allow the puff 260 to be implemented in a cover form and secured thereto in a simple covering manner.

Further, a vibration-motor mounting hole 233 is formed in the block-shaped front portion 232 of the puff connector 230 so that the vibration motor 250 is inserted and mounted to the vibration-motor mounting hole. This vibration-motor mounting hole is formed to communicate with the inner hollow portion 231*a* of the rear portion, thus enabling the vibration motor 250 to be easily inserted and mounted to the puff connector 230 from a rear position.

Moreover, a locking protrusion 231*b* is provided on a rear end of the rear portion 231 on the puff connector 230 in such a way so as to protrude outwards.

Here, the locking protrusion 231*b* of the puff connector 230 is a component that is firmly supported by the fastening of the fastening/supporting member 240 when the puff connector 230 is inserted into the body 210, and allows the puff connector 230 to be reliably coupled to the body 210.

The fastening/supporting member 240 is located in front of the body 210, and is disposed on the second step portion 223 of the body coupler 220 to be fastened to the body coupler 220 and support the puff connector 230, thus serving as a support coupling structure. The fastening/supporting member integrally has a fastening protrusion 241 and a support protrusion 242. The fastening protrusion is located on the second step portion 223 of the body coupler 220 to be fastened thereto, and the support protrusion extends rearwards from the fastening protrusion 241, defines a through hole to allow the rear portion 231 of the puff connector 230 to be passed and inserted, and comes into close contact with the locking protrusion 231*b* of the puff connector 230 to support it.

The vibration motor 250 provides the shake resulting from the vibration to the puff 260, and is fixedly inserted into the vibration-motor mounting hole 233 of the puff connector 230.

The vibration motor 250 has a wire 251 to be supplied with operating power, and is connected to the battery terminal portion 212 and the operating switch SW to be supplied with power and receive an operating signal.

The puff 260 is made of a latex or sponge (MBR foam, etc.) material, and is configured as a thin cover member to cover the head of the front portion 232 of the puff connector 230 that has the block structure.

The puff cover 270 is a cover means for protecting the puff connector 230 and the puff 260.

Even in this case, an elastic member 280 such as a spring may be further provided to maintain flexibility and elasticity for the puff connector 230, further increase a restoring force, and besides serve as a support structure for the puff connector 230. The elastic member is preferably inserted into the inner hollow portion 231*a* of the rear portion 231 of the puff connector 230.

Preferably, the elastic member 280 has a size corresponding to that of the inner hollow portion 231*a* of the puff connector 230.

Reference sign BC is a battery-terminal-portion cover member to cover the opening 224 that is formed to make the battery terminal portion 212 be opened.

In the makeup puff apparatus 200 according to the present invention constructed as described above, while the vibration motor 250 is inserted into the vibration-motor mounting hole 233 of the puff connector 230, the rear portion 231 of the puff connector 230 accommodating the vibration motor 250 therein is fitted and inserted into the fastening/supporting member 240.

Here, if the elastic member 280 is included, it is inserted into the inner hollow portion 231*a* of the rear portion of the puff connector 230.

Subsequently, the body 210 and the fastening/supporting member 240 are inserted into the body coupler 220 to be caught by the first step portion 222 and the second step portion 223. In such a state, the fastening/supporting member 240 is fastened to the body coupler 220, so that the puff connector 230 is coupled while being reliably supported.

Here, by the fastening operation of the fastening/supporting member 240, the rear end of the puff connector 230 having the locking protrusion 231*b* is located between the support plate 211 of the body 210 and the support protrusion 242 of the fastening/supporting member 240 to be in close contact therewith, thus maintaining the firm installation of the puff connector 230. The head of the puff connector 230 is located in front of the body coupler 220 to be exposed. Further, the mounting is carried out to efficiently show the flexibility and elasticity of the puff connector 230.

Thereafter, the thin cover-shaped puff 260 implemented as the cover member covers the head of the puff connector 230, and the puff cover 270 is coupled to the body coupler 220 by fitting.

Figure 6:
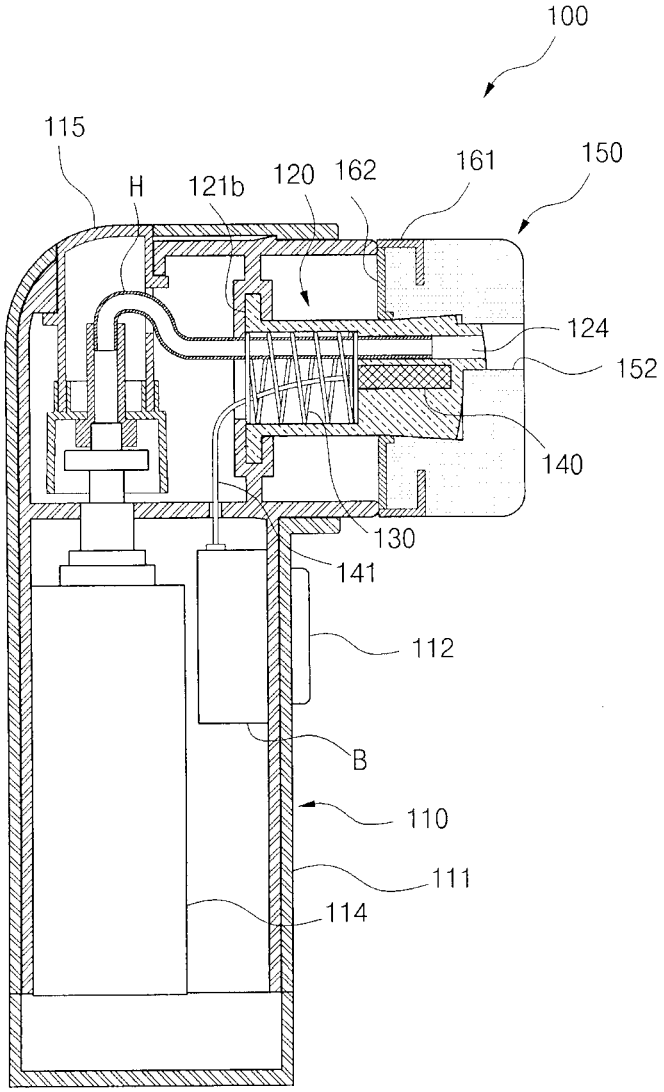
FIG. 6 is a sectional view showing a makeup puff apparatus according to a further embodiment of the present invention in an assembled state thereof.
Figure 7:
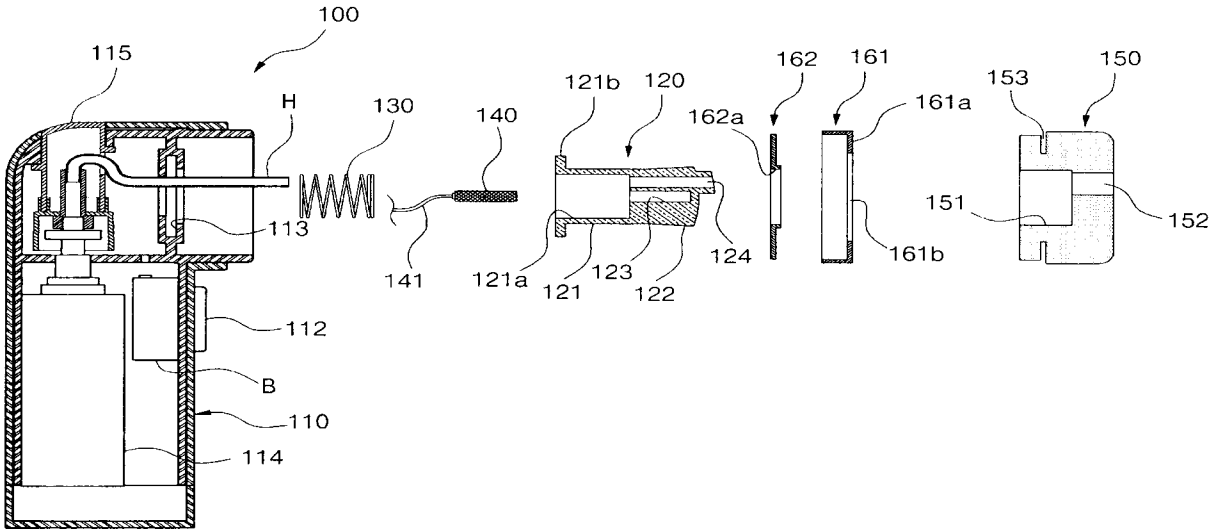
FIG. 7 is an exploded sectional view showing a configuration of FIG. 6 according to the present invention.

Further, FIGS. 6 and 7 illustrate a makeup puff apparatus 100 according to a further embodiment of the present invention, the makeup puff apparatus including a body 110, a puff connector 120, an elastic member 130, a vibration motor 140, and a puff 150.

The body 110 is provided with a handle portion 111 for gripping the puff apparatus 100 of the present invention, and a switch portion 112 for turning the vibration motor 140 on or off. A battery B for supplying power may be accommodated in and mounted to the body.

Also, a matching coupling groove 113 is formed in the body 110 so that a rear end of the puff connector 120 is fitted into the matching coupling groove, thus fixedly mounting and supporting the puff connector.

As shown in the drawings, a cosmetic storage container or a cosmetic storage portion 114 may be received or formed in the body 110 to pump and supply cosmetics such as foundation to the puff 150 as necessary. A supply hose H is connected to the cosmetic storage container or cosmetic storage portion. Further, a pumping button 115 for pumping may be provided on the body.

As such, the modification and variation of the body 110 may be made, and besides, the body may be shaped in various ways.

The puff connector 120 serves as a connector for fixedly placing the puff 150 on a front end of the body 110, and also becomes a component for inserting the vibration motor 140 therein. Preferably, the puff connector is made of a rubber material or silicone to effectively show flexibility and elasticity. The rear end of the puff connector 120 is secured and mounted to the body 110, thus supporting and coupling the puff connector.

To be more specific, in order to effectively show flexibility and elasticity, the puff connector 120 is configured so that a rear portion 121 has a tubular structure with an inner hollow portion 121*a*, while a front portion 122 has a block structure that is solid therein.

Further, a vibration-motor mounting hole 123 is formed in the block-shaped front portion 122 of the puff connector 120 so that the vibration motor 140 is inserted and mounted to the vibration-motor mounting hole. This vibration-motor mounting hole is formed to communicate with the inner hollow portion 121*a* of the rear portion, thus enabling the vibration motor 140 to be easily inserted and mounted to the puff connector 120 from a rear position.

Here, a coupling protrusion 121*b* is formed on the rear end of the puff connector 120 in such a way so as to protrude outwards and is fitted into the matching coupling groove 113 of the body 110, thus supporting and coupling the puff connector 120 to the body 110. A cosmetic supply hole 124 is provided in the front portion 122 to communicate with the inner hollow portion 121*a* of the rear portion and to be connected to and communicate with the supply hose H, thus defining a cosmetic supply path.

Further, although not shown in the drawings, a support step may be provided on an outer surface of the front end of the puff connector 120 to enhance a coupling force with the puff 150.

The elastic member 130 may be further provided to maintain flexibility and elasticity for the puff connector 120, further increase a restoring force, and besides serve as a support structure for the puff connector 120. The elastic member is preferably inserted into the inner hollow portion 121*a* of the rear portion 121 of the puff connector 120. As an example of the elastic member, it is possible to use a spring.

The vibration motor 140 provides the shake resulting from the vibration to the puff 150, and is fixedly inserted into the vibration-motor mounting hole 123 of the puff connector 120 via the inner hollow portion 121*a* of the rear portion 121.

Here, the vibration motor 140 has a wire 141 to be supplied with operating power, and is connected to the battery B and the switch portion 112 of the body 110 to be supplied with power and receive an operating signal.

The puff 150 is made of a latex or sponge (MBR foam, etc.) material, and a coupling recess 151 is formed in the puff to be fitted and coupled to the front end of the puff connector 120.

Here, the puff 150 is fitted over the front end of the puff connector 120 to be supported thereon, and is located on the front end of the body 110 in such a way so as to be exposed.

A cosmetic dispensing hole 152 is formed in the puff 150 in such a way so as to communicate with the cosmetic supply hole 124 of the puff connector 120.

In addition, in order to increase a coupling force between the puff connector 120 and the puff 150 as well as a force of supporting the puff 150, a cut groove 153 may be formed on an outer circumference of a body of the puff 150, and a first connecting member 161 and a second connecting member 162 may be further provided. The first connecting member has a corresponding fitting portion 161*a* to be fitted into the cut groove 153 of the puff 150, with a hole 161*b* being formed in a central portion of the first connecting member. The second connecting member is inserted into the first connecting member 161 to be secured thereto, and has a support hole 162*a* on a central portion thereof to allow the puff connector 120 to be inserted and supported thereto by a press fit.

As described above, the makeup puff apparatus 100, 200, 300 according to the above-mentioned embodiment of the present invention leads to the natural and flexible motion and shaking of the puff 150, 260, 360 when the puff 150, 260, 360 is vibrated or shaken by the operation of the vibration motor 140, 250, 340, and can continuously provide the soft touch sensation of the puff even if there occurs a variation in angle on a touch portion. Moreover, the puff connector and/or the elastic member affords a restoring force, thus very effectively preventing the angle of the puff 150, 260, 360 from deviating from a predetermined angle when the puff apparatus is in use, and contributing to the easy and convenient use of the puff apparatus.

Although the embodiments of the present invention have been disclosed for illustrative purposes, those skilled in the art will appreciate that various modifications, additions and substitutions are possible, without departing from the scope and spirit of the invention as disclosed in the accompanying claims.

*Description of Reference Numerals of Important parts*

| | |
|---|---|
| 300: puff apparatus | 310: body |
| 311: partition plate | 311a: hole |
| 320: body cover | 321: battery terminal portion |
| 322: switch portion | 330: puff connector |
| 331: rear portion | 331a: inner hollow portion |
| 331b: locking protrusion | 332: front portion |
| 333: vibration-motor mounting hole | 334: locking step |
| 340: vibration motor | 350: puff holder |
| 360: puff | 370: switching cover |
| 371: pressing portion | 380: puff cover |
| 390: elastic member | |

INDUSTRIAL APPLICABILITY

As described above, the present invention provides a makeup puff apparatus, which enables flexible motion and adjustment of a puff in conformity with a variation in angle on a touch portion, thus continuously maintaining the soft touch sensation of the puff, and which allows the puff apparatus to be immediately restored to its original state, thus preventing an angle of a puff from deviating from a predetermined angle, and thereby affording durability and enabling reliable operation. As a result, the invention concerns the makeup puff apparatus having industrial applicability.

The invention claimed is:

1. A makeup puff apparatus, comprising:

a body including a partition plate with a hole, thus defining open spaces, respectively, on a front portion and a rear portion of the body by the partition plate;

a body cover disposed on the rear open space of the body to be fastened thereto, supporting a back of a puff connector inserted into the body, and including a battery terminal portion for mounting a battery on a rear surface of the body cover, and a push switch portion;

the puff connector fitted into and located in the front open space of the body, and configured so that a tubular rear portion having an inner hollow portion to provide flexibility and elasticity is integrated with a block-shaped front portion having a vibration-motor mounting hole to communicate with the inner hollow portion;

a vibration motor inserted and mounted into the vibration-motor mounting hole of the puff connector;

a puff holder for firmly coupling or simply detaching a puff to or from the puff connector;

the puff attached to a front face of the puff holder via a double-sided tape or an adhesive, and fitted over a front end of the puff connector together with the puff holder; and a switching cover rotatably coupled to the rear portion of the body, with a pressing portion provided in the switching cover to have a step between left and right sides, thus switching the push switch portion on or off by a rotating operation.

2. The makeup puff apparatus according to claim 1, wherein an elastic member is inserted into the inner hollow portion of the rear portion of the puff connector to maintain flexibility and elasticity for the puff connector, further increase a restoring force, and besides serve as a support structure for the puff connector.

3. The makeup puff apparatus according to claim 1, wherein a locking step protrudes from an outer surface of the puff connector to restrict a movement of the puff holder for ensuring firm coupling of the puff towards the puff connector, thus keeping the puff and the body in a non-contact state.

4. The makeup puff apparatus according to claim 1, wherein a facial washing brush is substituted for the puff and is directly coupled to the puff connector, thus enabling a user to more cleanly wash his or her face so as to put on or remove makeup.

5. The makeup puff apparatus according to claim 1, wherein the puff connector is made of a rubber or silicone material.

6. A makeup puff apparatus, comprising:

a body including a support plate on a front end thereof, and a battery terminal portion integrally formed on a back of the support plate to enable mounting of a battery;

a body coupler adapted to insert and dispose the body therein and serving as a handle means for gripping the puff apparatus, the body coupler having an inner space that is open towards a front, with a first step portion and a second step portion being sequentially formed in the body coupler;

a puff connector contacting on a back thereof with the body, and supported and coupled via a fastening support member, the puff connector being configured so that a tubular rear portion having an inner hollow portion to provide flexibility and elasticity is integrated with a block-shaped front portion, with a vibration-motor mounting hole being formed in the front portion in such a way so as to communicate with the inner hollow portion;

the fastening support member located in front of the body, and disposed on the second step portion of the body coupler to fasten the body to the body coupler and support the puff connector, thus serving as a support coupling structure;

a vibration motor inserted and mounted into the vibration-motor mounting hole of the puff connector; and a puff disposed to cover the front portion of the puff connector.

7. The makeup puff apparatus according to claim 6, wherein an elastic member is inserted into the inner hollow portion of the rear portion of the puff connector to maintain flexibility and elasticity for the puff connector, further increase a restoring force, and besides serve as a support structure for the puff connector.

8. The makeup puff apparatus according to any one of claim 6, wherein the puff connector is made of a rubber or silicone material.

* * * * *